US006031438A

United States Patent [19]

Runyan

[11] Patent Number: 6,031,438

[45] Date of Patent: Feb. 29, 2000

[54] MID TRIP STOP FOR CIRCUIT BREAKER

[75] Inventor: Daniel James Runyan, Cambridge, Md.

[73] Assignee: Airpax Corporation, LLC, Frederick, Md.

[21] Appl. No.: 09/174,165

[22] Filed: Oct. 16, 1998

[51] Int. Cl.[7] ..... H01H 9/00

[52] U.S. Cl. ..... 335/172; 335/35; 335/167; 335/176

[58] Field of Search ..... 335/172, 165–176, 335/17, 22–24, 35, 38

[56] References Cited

U.S. PATENT DOCUMENTS

| | | | |
|---|---|---|---|
| 5,296,664 | 3/1994 | Crookston et al. | 200/401 |
| 5,731,560 | 3/1998 | Nebon et al. | 218/22 |
| 5,774,031 | 6/1998 | Linzenich et al. | 335/172 |
| 5,793,270 | 8/1998 | Beck et al. | 335/16 |

*Primary Examiner*—Michael L. Gellner
*Assistant Examiner*—Tuyen T. Nguyen
*Attorney, Agent, or Firm*—Milde, Hoffberg & MacKlin, LLP

[57] ABSTRACT

A mid-trip stop circuit breaker, having a handle, adapted for displacement about an axis of rotation between a first position and a second position, the handle being linked to a member whose position corresponds to a rotation position of the handle, a spring urging the handle toward the second position; a stop surface, displaceably supported in relation to the axis of rotation, the stop surface being selectively disposed along a path of the member at a middle position of a transition path from the first position to the second position, and being adapted to engage the member and counter a force of the spring, to retain the handle in the middle position of the transition path, such that a sufficient manual force applied to the handle when retained at the middle position of the transition path will displace the stop surface, allowing the handle to achieve the second position, while in an absence of the sufficient manual force and under influence of the spring alone, the stop surface impedes displacement of the handle and retains it in the middle of the transition path.

25 Claims, 6 Drawing Sheets

MID TRIP STATE

MID TRIP STOP FOR CIRCUIT BREAKER

FIELD OF THE INVENTION

The present invention relates to the field of circuit breakers, and more particularly to circuit breakers having a mid-trip stop for the external toggle handle to indicate the state of the circuit breaker.

BACKGROUND OF THE INVENTION

In the field of electrical circuit breakers, it is well known to provide an external indication of the internal state of the circuit breaker, for example ON, OFF, and TRIPPED.

A circuit breaker is a device, which serves to interrupt electrical current flow in an electrical circuit path upon the occurrence of an overcurrent in the circuit path. When the overcurrent occurs, the external toggle handle will normally return to the OFF position. However, a service technician of other user will have no indication whether the breaker was intentionally turned OFF or the breaker tripped. In complex breaker installations, where some breakers are normally maintained in an OFF position, this can make analysis difficult. Therefore, the art has taught the desirability of an external indication of switch state.

Various methods are available for indicating Trip State of a breaker. First, the external toggle handle may be provided with a "mid-trip" state, intermediate from the ON and OFF states. This is typically accomplished by a linkage between the external toggle and trip mechanism, wherein, upon a trip condition of the breaker, the trip mechanism assumes a state, which causes the external toggle to lie in an intermediate state. See, e.g., U.S. Pat. No. 5,264,673, 4,528,531, 3,970, 976, 3,955,162, and 3,863,042, expressly incorporated herein by reference. An electronic indicator may also be provided, for example, a light emitting diode, which is selectively illuminated by power from the load. See, e.g., U.S. Pat. No. 3,806,848, expressly incorporated herein by reference, or by means of an auxiliary switch, see, U.S. Pat. Nos. 3,742,402, 3,742,403, 3,863,042 and 3,955,162, expressly incorporated herein by reference. Some circuit breakers have an internal trip condition distinct from the OFF condition. See, e.g., U.S. Pat. No. 5,777,536. This latter solution, however, causes the problem that in the tripped condition, a small current still flows through the device. Other types of mechanical visual indicators are also possible.

The solution proposed in U.S. Pat. Nos. 3,955,162 and 3,863,042 provide a ramp surface of a flat spring, that is disposed within the path of a member extending from an internal portion of the handle. During each actuation of the circuit breaker, the flat spring is flexed, potentially resulting in stress-related failure of the spring. Since this spring is metallic, such failure poses a particular hazard of shorting the breaker. Further, it is often possible to "tease" the circuit breaker into the mid-trip state without an immediately antecedent trip event. The simple design is typically available only for smaller size circuit breakers, for example under 100 Amps rating, due to the inertia of the contact bar and handle, and the handle return spring of larger rating circuit breakers overcoming the retaining spring forces of the flat spring during a trip. Therefore, larger size breakers require damping of the handle movement by additional elements. Finally, in the design employing a flat spring, the handle assumes a mid-trip position even if the contacts are welded together, thus failing to warn service personnel that the protected circuit may be "live".

SUMMARY AND OBJECTS OF THE INVENTION

The present invention therefore provides a mechanical latch which, upon tripping of the breaker, holds the external toggle in an intermediate position after a trip, which may be manually moved thereafter to the OFF position.

The present invention also provides a mechanical latch that, upon tripping of the breaker, holds the handle in the ON position if the contacts fail to separate.

The present invention further provides a reliable and durable mid-trip latch mechanism.

The mechanical latch does not require substantial modifications or adaptations of the circuit breaker and trip mechanism, and thus is compatible with a wide range of breaker designs.

The mid-trip stop according to the present invention also provides a reliable indication of contact state within the breaker, so that if the contacts are welded together or the like, the external toggle will not move to the OFF position.

The mid-trip stop according to the present invention relies on the loss of retaining force of the collapsible toggle linkage within the breaker, during trip event. When the breaker trips, the toggle arm flexes in its central portion, under the spring force of the contact arm spring. Normally,. without the mid-trip stop, after the collapsible toggle arm collapses, the internal toggle spring urges the external toggle to the OFF position, thus lengthening the collapsible toggle linkage into its locked position, ready for a circuit reset. However, according to the present invention, a mechanical stop linked in fixed relation to the handle, stops displacement of the external toggle handle. For example, the pin that connects the external toggle handle to the cam link may be extended, to provide member for internally controlling a position of the handle. The mechanical latch is mounted for rotation about an axis, such that a small force (in excess of the force normally applied by the handle spring) will release the external handle, from the stop surface of the latch, to the OFF position. In the mid-trip position defined by the retention of the external handle by the stop surface, the collapsible toggle arm remains collapsed or flexed, and therefore unlocked. Therefore, an intervening movement of the external handle to the OFF position is necessary to reset the breaker from the mid-trip position to the ON position.

It is therefore an object of the invention to provide a mid-trip stop for a circuit breaker handle, comprising a stop surface on a rigid arm, disposed to automatically hold a circuit breaker handle in a mid-trip position until reset.

It is a further object according to the present invention to provide an automatic external indication of circuit breaker contact status wherein a position of an external handle represents the contact closed and the breaker tripped (contact open) states.

These and other objects will be apparent from an understanding of the preferred embodiments.

BRIEF DESCRIPTION OF THE DRAWINGS

These and further objects and advantages of the invention will be more apparent upon reference to the following specification, claims and appended drawings wherein:

DETAILED DESCRIPTION OF THE PREFERRED EMBODIMENTS

Figure 1:
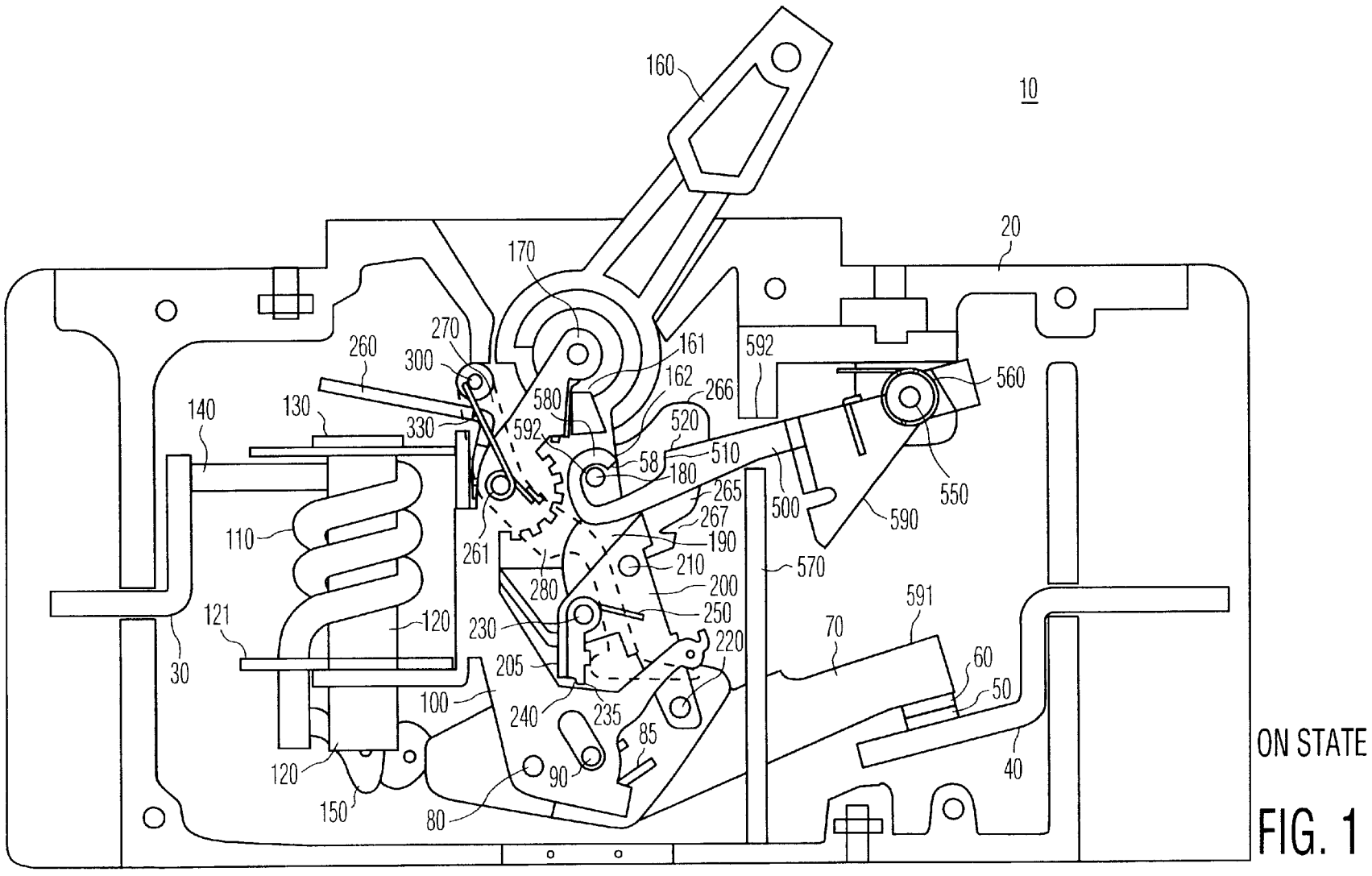
FIG. 1 is a side view a of first embodiment of a circuit breaker mechanism with a housing half removed, having a mid-trip stop.

The preferred embodiments will no be described by way of example, in which like reference numerals indicate like elements.

EXAMPLE

Figure 2B:
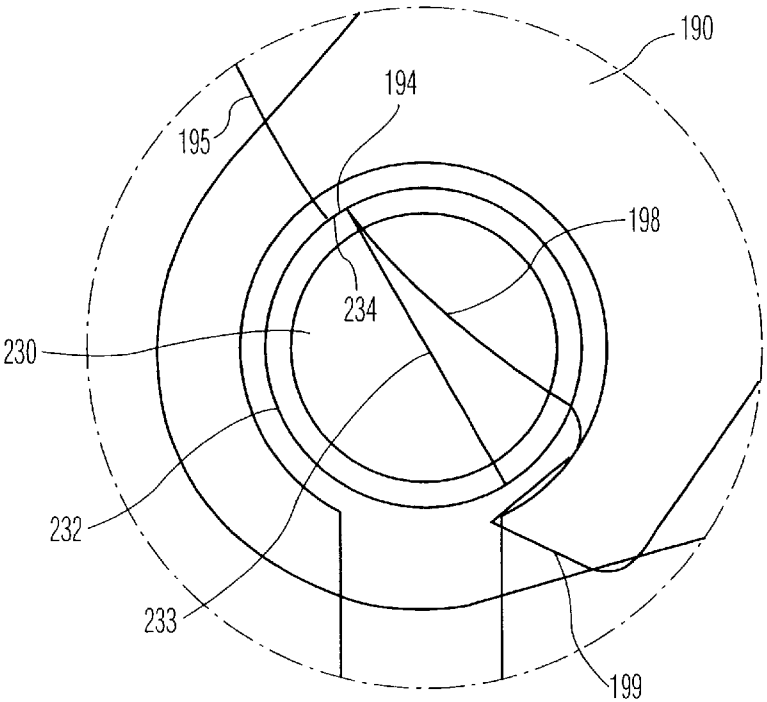
FIG. 2B PRIOR ART
FIGS. 2A and 2B are detail views of a known breaker toggle mechanism.
Figure 2A:
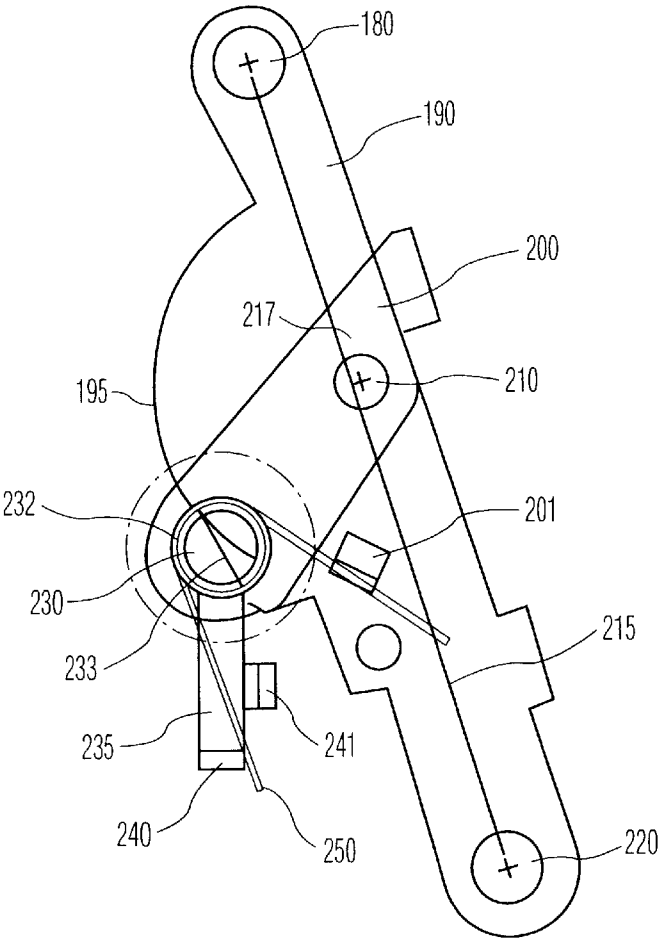
FIG. 2A PRIOR ART

Components of a conventional type single pole circuit breaker are depicted in FIGS. 1, 2A and 2B. See, U.S. Pat. No. 5,293,016, expressly incorporated herein by reference. As shown, the single pole circuit breaker 10 includes an electrically insulating casing 20 which houses, among other things, stationary mounted terminals 30 and 40. In use, these terminals are electrically connected to the ends of the electrical circuit that is to be protected against overcurrents.

As its major internal components, a circuit breaker includes a fixed electrical contact, a movable electrical contact, an electrical arc chute, and an operating mechanism. The arc chute is used to divide a single electrical arc formed between separating electrical contacts upon a fault condition into a series of electrical arcs, increasing the total arc voltage and resulting in a limiting of the magnitude of the fault current. See, e.g., U.S. Pat. No. 5,463,199, expressly incorporated herein by reference.

The trip mechanism includes a contact bar, carrying a movable contact of the circuit breaker, which is spring loaded by a multi-coil torsion spring to provide a force repelling the fixed contact. In the closed position, a hinged linkage between the manual control toggle is held in an extended position and provides a force significantly greater than the countering spring force, to apply a contact pressure between the moveable contact and the fixed contact. The hinged linkage includes a trigger element which, when displaced against a small spring and frictional force, causes the hinged linkage to rapidly collapse, allowing the torsion spring to open the contacts by quickly displacing the moveable contact away from the fixed contact. The trigger element is linked to the trip element.

As is known, the casing 20 also houses a stationary electrical contact 50 mounted on the terminal 40 and an electrical contact 60 mounted on a contact bar 70. Significantly, the contact bar 70 is pivotally connected via a pivot pin 80 to a stationary mounted frame 100. A helical spring 85, which encircles the pivot pin 80, pivotally biases the contact bar 70 toward the frame 100 in the counterclockwise direction per FIG. 1. A contact bar stop pin 90 or contact bar stop mounted on the contact bar 70 (or optionally other stop, such as a surface which contacts the frame), limits the pivotal motion of the contact bar 70 relative to the frame 100 in the non-contacting position (contact bar 70 rotated about pin 80 in the counterclockwise direction to separate contacts 50 and 60, not shown in FIG. 1). By virtue of the pivotal motion of the contact bar 70, the contact 60 is readily moved into and out of electrical contact with the stationary contact 50. In the contacting position (shown in FIG. 1), the stationary contact 50 limits the motion of the contact 60, thus limiting the angular rotation of the contact bar 70 about pin 80. The pivot pin 80 sits in a conforming aperture in the frame, while a slot 81 is provided in the contact bar 70 to allow a small amount of vertical displacement. Thus, in the contacting position, the contact bar 70 may be displaced vertically by the pressure of the toggle linkage composed of cam link 190 and link housing 200 in the aligned relative orientation (shown in FIG. 1), against a force exerted by the helical spring 85.

An electrical coil 110, which encircles a magnetic core 120 topped by a pole piece 130, is positioned adjacent the frame 100. An extension 140 of the coil material, typically a solid copper wire, or an electrical braid, serves to electrically connect the terminal 30 to one end of the coil 110. An electrical braid 150 connects the opposite end of the coil 110 to the contact bar 70. Thus, when the contact bar 70 is pivoted in the clockwise direction (as viewed in FIG. 1), against the biasing force exerted by the spring 85, to bring the contact 60 into electrical contact with the contact 50, a continuous electrical path extends between the terminals 30 and 40.

Magnetic core 120 includes a delay tube. By way of example only, the coil and delay tube assembly may be of the type shown and described in U.S. Pat. No. 4,062,052, expressly incorporated herein by reference.

Figure 3A:
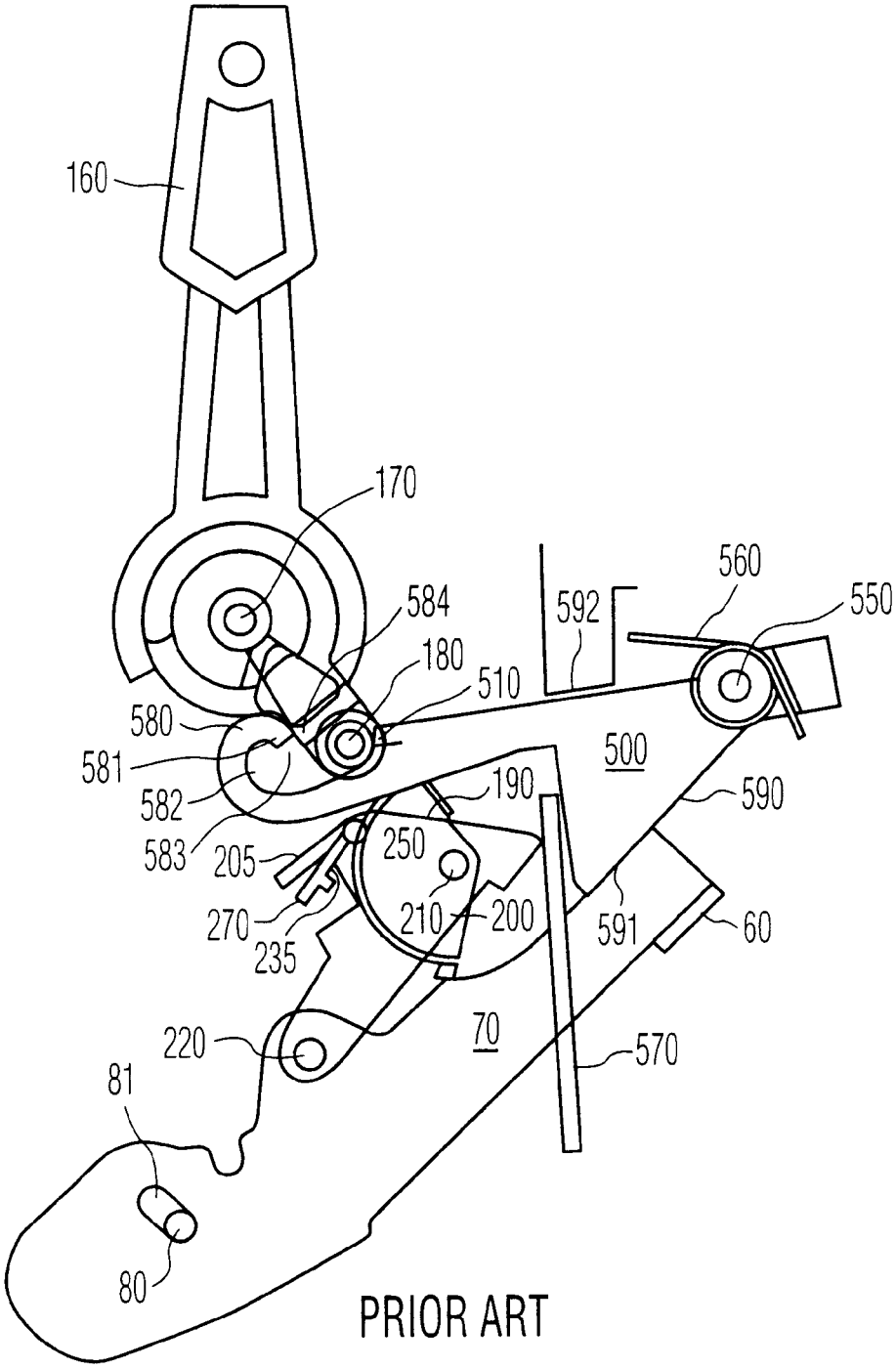
FIGS. 3A and 3B shows simplified views, respectively of the first embodiment of the circuit breaker according to FIG. 1 in a mid-trip position and OFF position.
Figure 3B:
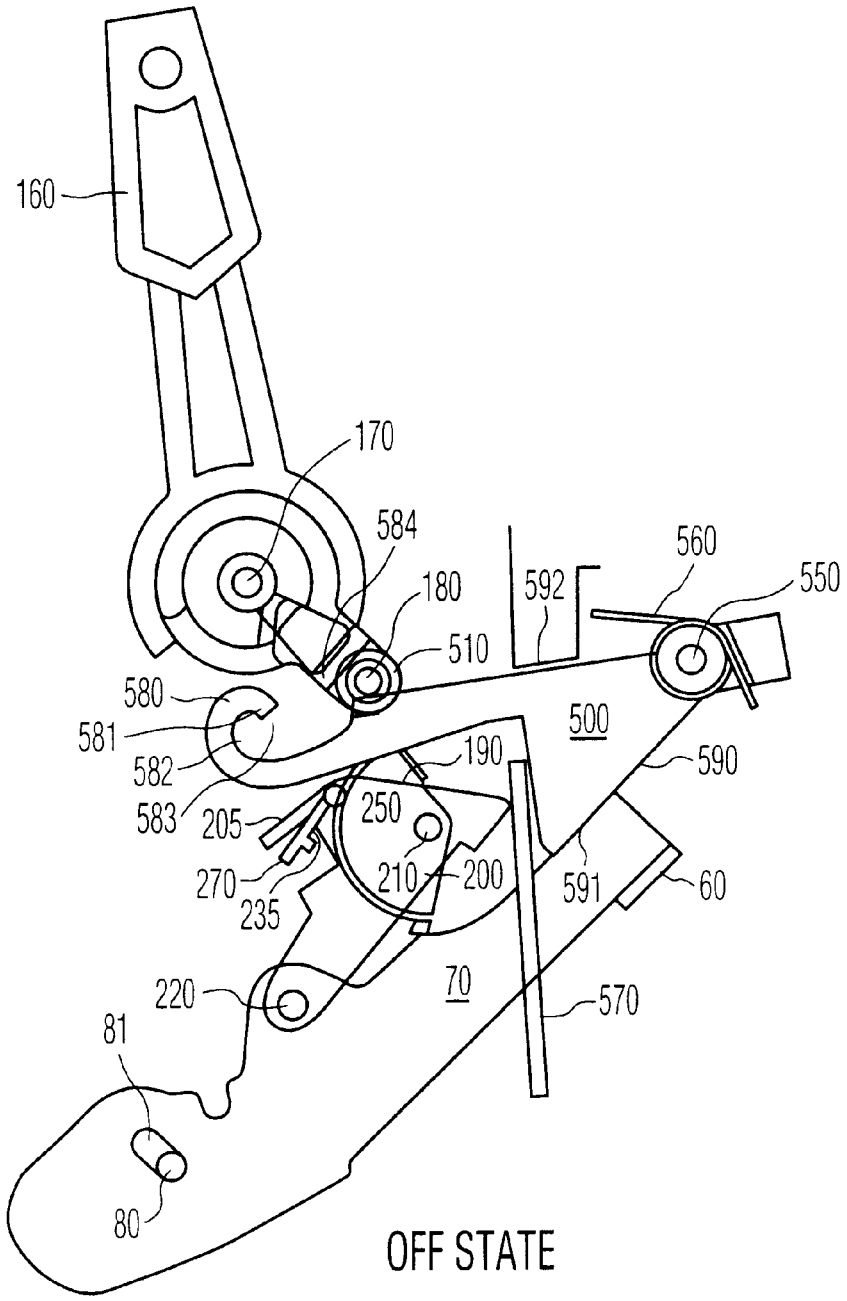

Magnetic core 120 has at an upper position thereof, a pole piece 130. Adjacent pole piece 130 is an armature 260 pivotally mounted on a pin 261 secured to frame 100. Armature 260 is rotatably biased in a clockwise direction (relative to FIG. 3) by a spring (not shown), and comprises an arm 265 and a counterweight 266. Counterweight 266 comprises an enlarged extension of armature 260, and may include a slot 267 for receiving a pin of an inertia wheel rotatably mounted on frame 100, not shown. See, U.S. Pat. Nos. 3,497,838, 3,959,755, 4,062,052, and 4,117,285, expressly incorporated herein by reference.

The delay tube of the magnetic core 120 is a typical design, which is disclosed, for example, in U.S. Pat. No. 4,062,052, expressly incorporated herein by reference. In this design, an outer tube 122 of the magnetic core 120 is supported in the frame 100 by a bobbin 121, about which the coil 110. The outer tube is a drawn single piece shell, sealed at its open end by the pole piece 130. The interior of the delay tube is conventionally filled with a viscous fluid such as oil. Typically, the viscosity of the oil is selected to provide a desired damping within a standard delay tube design, although mechanical modifications, most notably with respect to the clearance around a magnetic delay core (not shown in FIG. 1) or slug in the outer tube 122, will also influence the damping or delay of the system. The construction materials of the magnetic delay core or slug and pole piece 130 may also alter the force induced by the coil 110. The delay core or slug is biased away from the pole piece 130 by a helical spring provided within the outer shell 122. For example, the delay core has an enlarged lower end and a reduced diameter upper end around which a portion of spring passes, and defining an annular shoulder against which the lower end of the spring bears. In conventional circuit breaker delay tubes, the distance from the bottom of the core to the plane containing the bottom of the coil 110, is customarily chosen to be about one-third of the overall interior distance of the delay tube, namely from the bottom of the core to the underside of the pole piece 130. Customarily, the coil 110 surrounds the upper two-thirds of the delay tube outer shell 122. This conventional construction optimizes the delay function of the tube while, at the same time, maintaining the overall length of the tube within reasonable bounds.

When a prolonged overcurrent passes through coil 110, delay core moves upwardly in the outer shell 122, with motion damped by the viscous oil, to compress spring until the upper end of delay core engages pole piece 130, causing an increased magnetic flux in the gap between the pole piece 130 and armature 260, so that the armature 260 is attracted to the pole piece 130 and rotates about its pivot 261 to engage the sear striker bar 240 to result in collapse of the toggle mechanism, separating the electrical contacts and opening the circuit in response to the overcurrent, as will become apparent below.

The circuit breaker 10 also includes a handle 160, which is pivotally connected to the frame 100 via a pin 170. Handle 160 includes a pair of ears 162 with apertures for receiving a pin 180, which connects handle 160 to a cam link 190. In addition, a toggle mechanism is provided, which connects the handle 160 to the contact bar 70. The handle 160 is provided with a helical spring 161, which applies a counterclockwise force on the handle 160 about pin 170 with respect to frame 100. A significant feature of the cam link 190, shown in expanded view in FIG. 2B, is the presence of a step, formed by the intersection of non-parallel surfaces 194 and 198, in the outer profile of the cam link 190. Cam link 190 is pivotally connected by a rivet or pin 210 to a housing link 200.

With further reference to FIGS. 2A and 2B, the toggle mechanism of the circuit breaker 10 also includes a link housing 200, which is further connected a projecting arm 205. The link housing is pivotally connected to the cam link 190 by a pin or rivet 210 and pivotally connected to the contact bar 70 by a rivet 220.

The toggle mechanism further includes a sear assembly, including a sear pin 230 which extends through an aperture in the link housing 200 generally corresponding to a location of an outer edge 195 of the cam link 190. This sear pin 230 includes a circularly curved surface 232 (see FIG. 2B) which is intersected by a substantially planar surface 233. The sear assembly also includes a leg 235 (see FIG. 2A), connected to the sear pin 230, and a sear striker bar 240, which is connected to the leg 235 and projects into the plane of the paper, as viewed in FIG. 2A. A helical spring 250, which encircles the sear pin 230, pivotally biases the leg 235 of the sear assembly clockwise, into contact with the leg 205 of the link housing 200, and biasing the planar surface 233 of the sear pin 230 into substantial contact with the bottom surface 198 of the step in the cam link 190. A force exerted against the sear striker bar 240 is transmitted to the leg 235, and acts as a torque on the sear pin 230 to angularly displace the substantially planar surface 233 of the sear pin 230 from coplanarity the surface 198 of the cam link 190, thus raising the leading edge 234 of the substantially planar surface 233 of the sear pin 230 above the top edge of the surface 194. This rotation results in elimination of a holding force for the contact bar 70 in the contacting position, generated by the helical spring 85 acting on the contact arm 70, through the rivet 220 and link housing 200 and sear pin 230 leading edge 234, against the surface 194 of the cam link 190, acting on the pin 180, ears 162 of handle 160, held in place by pin 170 with respect to the casing 20 and frame 100.

The initial clockwise rotation of the cam link 190 is limited by a hook 199 in the outer profile of the cam link 190, at a distance from the step, which partially encircles, and is capable of frictionally engaging, the sear pin 230. In addition, the distance from the step to the hook 199 is slightly larger than the cross-sectional dimension, e.g., the diameter, of the sear pin 230. This dimensional difference determines the amount of clockwise rotation the cam link 190 undergoes before this rotation is stopped by frictional engagement between the hook 199 and the sear pin 230.

As a consequence, the sear pin 230 engages the step in the cam link 190, i.e., a portion of the surface 194 of the cam link 190 overlaps and contacts a leading portion of the curved surface 232 of the sear pin 230. Thus, it is by virtue of this engagement that the toggle mechanism is locked and thus capable of opposing and counteracting the pivotal biasing force exerted by the spring 85 on the contact bar 70, thereby maintaining the electrical connection between the contacts 50 and 60.

By manually pivoting the handle 160 in the counterclockwise direction (as viewed in FIG. 1), the toggle mechanism, while remaining locked, is translated and rotated out of alignment with the pivotal biasing force exerted by the spring 85 on the contact bar 70. This biasing force then pivots the contact bar 70 in the counterclockwise direction, toward the frame 100, resulting in the electrical connection between the contacts 50 and 60 being broken, thus assuming a noncontacting position. When in the full counterclockwise position, the handle 160 applies a slight tension or no force on the cam link 190, resulting in a full extension of the cam link 190 with respect to the link housing 200. In this position, the leading edge of the surface 232 of the sear pin 230 engages the surface 194, and thus the toggle mechanism is in its locked position. Therefore, manually pivoting the handle 160 from the left to right, i.e., in the clockwise direction, then serves to reverse the process to close the contacts 50, 60, since a force against the action of spring 85 is transmitted by clockwise rotation of the handle to the contact bar 70.

As shown in FIG. 1, the armature 260, pivotally connected to the frame 100, includes a leg 265 which is positioned adjacent the sear striker bar 240. In the event of an overcurrent in the circuit to be protected, this overcurrent will necessarily also flow through the coil 110, producing a magnetic force which induces the armature 260 to pivot toward the pole piece 130. As a consequence, the armature leg 265 will strike the sear striker bar 240, pivoting the sear pin 230 out of engagement with the step (intersection of surfaces 194, 198) in the cam link 190, thereby allowing the force of spring 85 to collapse the toggle mechanism. In the absence of the opposing force exerted by the toggle mechanism, the biasing force exerted by the spring 85 on the contact bar 70 will pivot the contact bar 70 in the counterclockwise direction, toward the frame 100, resulting in the electrical connection between the contacts 50 and 60 being broken.

As a safety precaution, the operating mechanism is configured to retain a manually engageable operating handle 160 in its ON or an intermediate, tripped position, if the electrical contacts 50, 60 are welded together. Thus, the handle 160 will not assume the OFF position if the contacts are held together. In addition, if the manually engageable operating handle 160 is physically restricted or obstructed in its ON position, the operating mechanism is configured to enable the electrical contacts 50, 60 to separate upon a trip, e.g., due to an overload condition or upon a short circuit or fault current condition. See, U.S. Pat. No. 4,528,531, expressly incorporated herein by reference.

Two or more single pole circuit breakers 10 are readily interconnected to form a multipole circuit breaker. In this configuration, each such single pole circuit breaker 10 further includes, as depicted in FIG. 1, a trip lever 270 (shown in dotted line) which is pivotally connected to the frame 100 by pin 261, which also is the pin about which the armature 260 pivots. The trip lever 270 is generally U-shaped and includes arms 280 (shown in FIG. 1) and 290 (not shown in FIG. 1) which at least partially enfold the frame 100. A helical spring 330, positioned between the frame 100 and the arm 280 and encircling the pin 162, pivotally biases the trip lever toward the frame 100. A projection 300 of the trip lever 270, which, as viewed in FIG. 1, projects out of the plane of the paper, is intended for insertion into a corresponding aperture in the trip lever of an adjacent single pole circuit breaker. Thus, any pivotal motion imparted to the trip lever 270, in opposition to the biasing force exerted by the spring 330, is transmitted to the adjacent trip lever, and vice versa. The projection 300 and aperture of a trip lever of an adjacent breaker, are preferably tapered, to ensure a secure fit therebetween. When the toggle link collapses, a protrusion 291 (not shown in FIG. 1) from the contact bar 70 displaces a cam surface 292 of the arm 290, thus rotating the trip lever about pin 261, and displacing the projection 300. The projection 300 thus moves in an arc about the pin 261, and thus an arcuate slot is provided in a housing half of housing 20 to transmit forces through the projection 300. A portion of arm 280 acts directly on the sear striker bar 240, to trip the associated toggle mechanism of an adjacent switch pole. A protrusion from the frame, for example a stop, limits the motion of arm 290 of the trip lever 270, in response to a bias spring about the pivot axis. Thus, Since the trip lever 270 is not operated directly by the armature 260, the trip dynamics of the circuit breaker are unaffected. The drag on the trip mechanism from the trip lever 270 is insignificant.

Side 280 has a cam surface 285, having a bend of about 45 degrees, which engages the sear striker bar 240 at about the position of the bend. Side 290 has a bend 293, forming cam surface 292, which is perpendicular with the portion of the side 290. Protrusion 291 extends from the side of the moveable contact bar 70, which contacts the surface 292 midway through the travel of the contact bar 70. When the contact bar 70 is displaced, the protrusion 291 pushes against the surface 292, causing a rotation about the pin 261, causing the surface 285 of side 280 to displace the sear striker bar 240. It is clear that in operation, rotation of trip lever 270 about pin 261 will result in tripping of the toggle mechanism, and tripping of the toggle mechanism will result in rotation of the trip lever about the pin 261. See, e.g., U.S. Pat. Nos. 5,557,082, 5,214,402, 5,162,765, 5,117,208, 5,066,935, and 4,912,441, expressly incorporated herein by reference. See also, U.S. Pat. Nos. 4,492,941, 4,437,488, 4,276,526, and 3,786,380, expressly incorporated herein by reference.

The circuit breaker includes a case 12 formed of half casings of electrically insulating material, such as plastic, e.g., Bakelite, from a pair of complementary casing halves 14 and 16. During assembly, the casing halves are secured together by rivets or similar fasteners (not shown) through a plurality of upper and lower fastener holes.

To extinguish arcing caused by opening of the contacts 50 and 60, a stacked array of metal plates are supported within and by the two half cases 14 and 16 of the circuit breaker around the moveable contact arm 70.

EXAMPLE

According to one embodiment of the present invention, a trip stop is provided having a surface disposed in the path of the pin 180 as it rotates counterclockwise about the axis formed by pin 170 through the center of the handle 160. Typically, this surface, or its supporting structures, will also be disposed in the path of clockwise rotation of the pin 180.

When the toggle mechanism collapses, as a result of a rotation of the sear pin 230, the cam link rotates counterclockwise about rivet 210, thus allowing the spring 85 to cause the contact bar 70 to move counterclockwise about pin 80. Housing link 200 rotates clockwise with respect to pin to rivet 220, and for example, the rightmost surface of the housing link 200 may be almost parallel with the contact bar 70. In this configuration, the toggle mechanism is flexed, and the forces, which are transmitted to the handle 160, causing it to rotate in the counterclockwise direction about pin 170, are as follows:

(a) relatively small frictional forces transmitted through the rivet 220, pin or rivet 210, the sear pin 230 brushing against the cam link 190 cylindrical outer surface, friction about pin 180 and about pin 170;

(b) an inertial force transmitted through the toggle mechanism as a result of the rapid rotation of the contact bar 70 and collapse of the toggle mechanism; and (c) a spring force generated by spring 161.

As can be seen, therefore, with the collapse of the toggle mechanism, while the sear pin 230 is unengaged with the cam link 190, a force on the handle 160 approximates the spring force of spring 161, as the other forces are relatively small. Therefore, a force somewhat greater than the spring force of spring 161 will impede the counterclockwise movement of the handle 160. When this force is applied before the handle 160 reaches its full counterclockwise rotation position, the handle 160 will be retained in a mid-trip position, indicating a prior trip of the toggle mechanism without a subsequent reset of the handle 160 to the full counterclockwise rotation position.

Figure 4A:
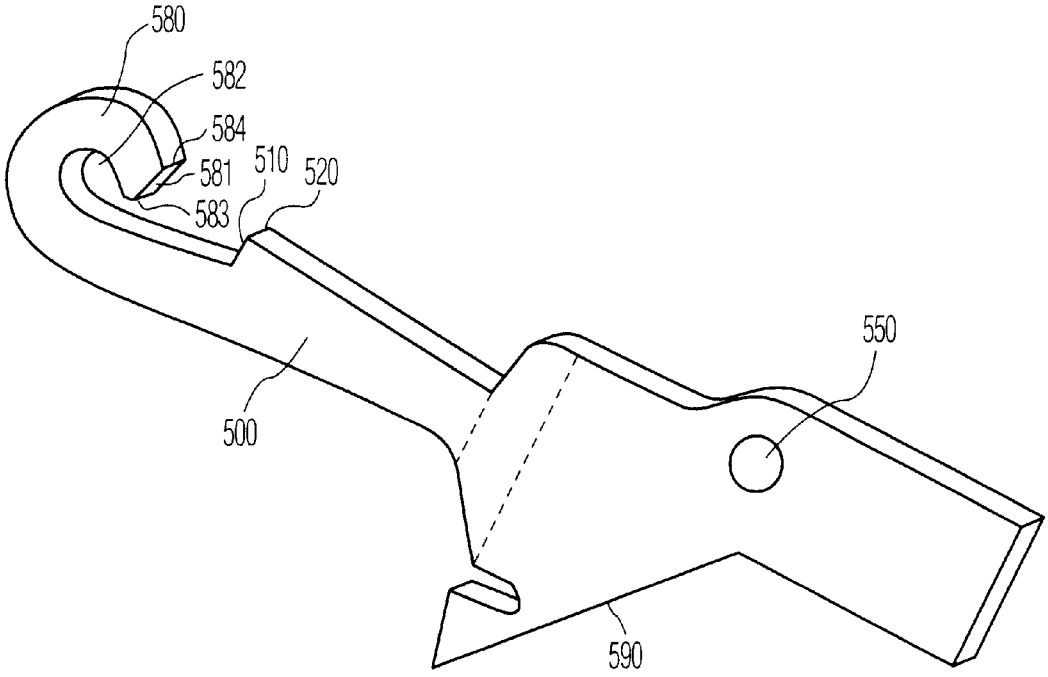
FIGS. 4A and 4B is a perspective view of the trip stop member for the first embodiment, and an optional shape having the same function, both according to the present invention.
Figure 4B:
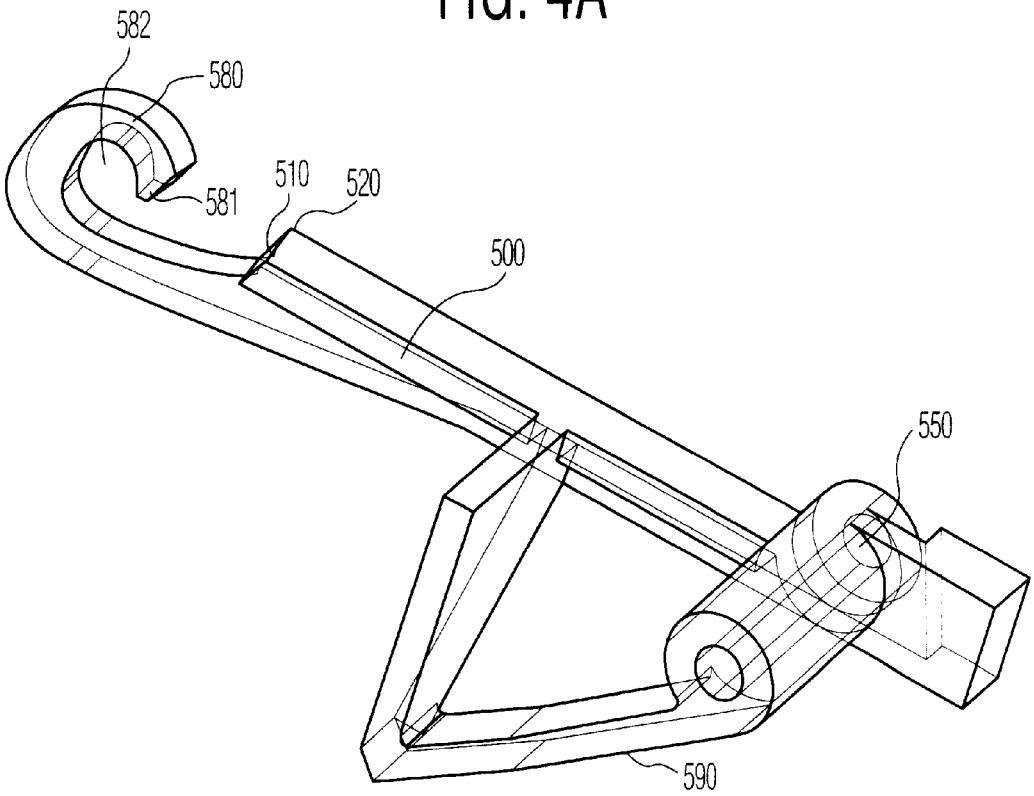

Advantageously, the force is applied on pin 180, or an extension thereof, by a surface disposed along its counterclockwise rotation path. As shown in the figures a catch arm 500 is provided. In this case, the catch arm is held by the case 20 via pin 550. A helical spring 560 is provided about pin 550 to provide biasing counterclockwise rotational force, thus tending to displace the arm downward, away from the path of movement of the pin 180 during rotation of the handle 160 counterclockwise. FIG. 4B shows an alternative design of the catch arm having essentially the same functions.

In the embodiment shown, the breaker is typically larger than 100 Amps (single pole), for example 250 Amps, in rated capacity. This implies a relatively large size and, more importantly, substantial spring forces, for example of the helical spring 85, and of the contact force between contacts 50, 60, as compared with smaller circuit breaker ratings. However, it should be understood that the principles may be applied to circuit breakers of any size, smaller or larger than those described in detail herein.

In the contacting position of the contact bar 70, the catch arm 500 is limited in its clockwise rotation about pin 550 by a plate 570, which is, for example, an insulating fiberboard. A catch 580 is provided at the distal end of the catch arm 500, having an inclined leading surface 581. The catch arm 500 is rigid, for example formed of stamped 1/16-inch thick steel sheet, having a lower (counterclockwise rotation) limit of motion defined by a stop surface of the plate 570. An upper tip 584 of the inclined leading surface 581, in the lower limit position, is disposed medial to the path of movement of the pin 180 about the axis defined by pin 170. Therefore, during clockwise rotation of the handle 160 about pin 170 into the contacting position, the pin 180 will ride distal with respect to pin 170 to the upper tip 584, riding against the inclined leading surface 581, and cause the catch arm 500 to rotate clockwise slightly about pin 550, to set the pin 180 in the catch recess 582.

When the circuit breaker 10 is tripped, such as by an overcurrent in the coil 110, the sear pin 230 rotates, allowing the toggle mechanism to flex (collapse), under the action of the helical spring 85. This will immediately cause the contact bar 70 to quickly rotate counterclockwise with respect to the pivot pin 80. The catch arm 500 has a lower extension 590, which is disposed in the path of the distal rear portion 591 of the contact bar 70. Thus, under influence of the helical spring 85 and inertia of the contact bar 70, the catch arm 500 is rapidly rotated clockwise. The spring force of spring 560 is small as compared to the spring force of the helical spring 85, so that the force of helical spring 85 controls the state of the catch arm 500. The rotation of the catch bar 500 is limited in a clockwise direction by a portion 592 of the case 20. In this position, the catch recess 582 is displaced so that the pin 180 is not thereby engaged, i.e., the lower tip 583 of the inclined leading surface is displaced medial of the pin 180 with respect to the pin 170.

If the contact bar 70, for any reason, fails to displace the catch arm 500, for example due to welding of the contacts 50, 60 in the contacting position, then the catch arm 500 will not automatically release the pin 180 holing the handle 160 in the ON position. Therefore, even though the breaker is "tripped", the handle will accurately indicate the contact position as being closed.

If the contact bar 70 does displace the catch arm 500, the surface 5 10 is then disposed directly in the counterclockwise rotation path of the pin 180 about pin 170. Thus, the counterclockwise rotation of the pin 180 and handle 160 about pin 170, due to the spring 161, is limited by the surface 510, and the handle 160 is stopped in the mid-trip position. In order to reset the handle 160 to the OFF position, a force is manually applied to the handle 160 which results in a force on the pin 180 to displace the catch arm 500, primarily against the force of helical spring 85.

In the ON position, the handle 160 is rotated to its limit in the clockwise position. A manual force in the counterclockwise direction applied to the handle 160 from the ON state will cause a torque in the catch arm 500, tending to cause a clockwise rotation thereof. At first, the pin 180 is held by the catch 580; however, as a force is exerted, the pin 180 disengages the catch 580 due to the inclination of the hooked catch surface and pivoting of the catch arm 500 mounting, until the pin 180 passes lateral to the lower tip 583. The pin 180 then passes unimpeded in the counterclockwise direction to its limit position, i.e., the OFF position. Since the surface 510 is not disposed in the path of the pin 180, due to the clockwise urging of the spring 560, it is not possible to manually place the handle 160 in the mid-trip position. The handle is thus able to freely move in the counterclockwise direction and assume the reset or OFF position, in which the contact arm 70 presses the catch arm 500 upward by contact of the distal rear portion 591 and the lower extension 590.

During a manual reset of the circuit breaker into the OFF position, the sear pin 230 remains engaged with the step in the cam link 190, permitting reactivation of the circuit breaker to the contacting position by a subsequent clockwise rotation of the handle 160. When the handle 160 is manually rotated clockwise from the OFF position, the lower extension 590 of the catch arm 500 is no longer contacted by the distal rear portion 591 and the spring 560 rotates the catch arm 500 counterclockwise, so that the leading inclined surface 581 is disposed in the path of the pin 180, allowing further clockwise rotation of the handle 160 to displace the catch arm 500 clockwise to pass the pin 180 distal with respect to the pin 170 to the lower tip 583, thereby allowing the pin 180 to engage the catch 580.

COMPARATIVE EXAMPLE

In a known-type system, as disclosed, for example, in U.S. Pat. Nos. 3,955,162, and 3,863,042, expressly incorporated herein by reference, a ramped surface is provided on a compliant flat spring support, which is held fixed in position with resect to the frame.

Figure 5:
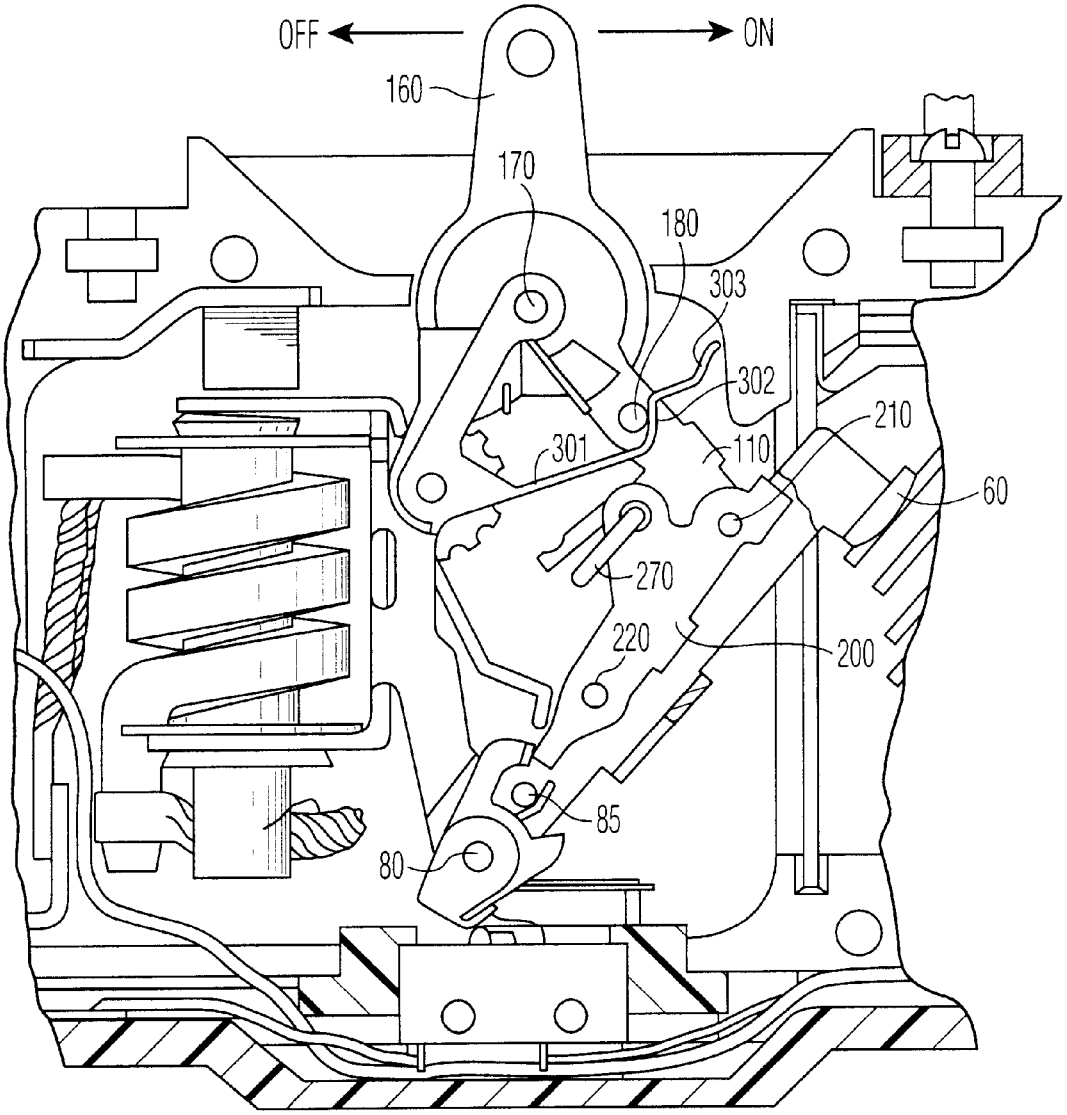
FIG. 5 PRIOR ART
FIG. 5 shows a prior art mid-trip stop.

In this system, shown in FIG. 5 the holding force of a surface 302 disposed in the path of the handle-toggle linkage connecting pin 180 is limited, and the breaker is typically limited to designs under 100 Amps (single pole) in capacity, without additional elements.

In order to turn the circuit breaker OFF or reset the circuit breaker from the mid-trip position, a manual counterclockwise rotational force is applied to the handle 160. This rotation causes the handle-toggle connecting linkage pin 180 to press against the ramped surface 302, which results in the flexion of the compliant flat spring support 301, which is, for example, a bent flat beryllium copper spring. This flexion with each actuation of the circuit breaker may result in mechanical failure over time. This flexion of the support 307 allows the handle-toggle linkage connecting pin 180 to rise above an apex of the ramped surface 302, thus allowing the handle 160 to rotate to the OFF position. In some cases, it is possible to "tease" the handle into the mid-trip position without an immediately antecedent trip event.

During activation of the circuit breaker (closing of the contacts) to the ON position, by clockwise rotation of the handle 160, the handle-toggle linkage connecting pin 180 encounters another inclined surface portion 303 of the compliant flat spring support, which is then flexed by the forces generated by the handle-toggle linkage connecting pin 180. As this pin 180 passes the apex, it is thereafter unimpeded by the compliant flat spring support 301.

The invention may be embodied in other specific forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are, therefore, intended to be embraced therein.

The term "comprising", as used herein, shall be interpreted as including, but not limited to inclusion of other elements not inconsistent with the structures and/or functions of the other elements recited.

What is claimed is:

1. A mid-trip stop for a circuit breaker, the circuit breaker having:

an external handle displaceable about an axis between a first handle position and a second handle position, the external handle having a member which rotates with the external handle about the axis of rotation through a transition path;

a spring urging the external handle toward the second handle position;

a trip mechanism having an operating position and a trip position;

a displaceable contact mechanism having an deactivated position and an activated position;

said mid-trip stop within the circuit breaker comprising:

a rigid support having a stop surface and means for selectively impending a movement of the member along the transition path; and a displaceable mounting for said rigid support, having a predetermined range of displacements in relation to the axis of rotation of the external handle, said impeding means selectively retaining the member in the first handle position by impeding its movement against a force exerted by the spring when the contact mechanism is in the activated position and releasing the member from the first handle position when the contact mechanism is in the deactivated position.

2. The mid-trip stop according to claim 1, wherein said rigid support is displaced via said displaceable mounting by action of the contact mechanism in the deactivated position such that said stop surface is disposed along a central portion of the transition path of the member, to impede a rotational displacement of the member about the axis of rotation from the first handle position to the second handle position due to a force generated by the spring, holding the external handle in the central portion of the transition path, and thereafter allows the member to advance past the central portion of the transition path, upon the exertion of a force greater than a force exerted by the spring, to release the external handle to the second handle position.

3. The mid-trip stop according to claim 1, wherein said stop surface is displaced clear of the transition path when the contact mechanism is in the activated position.

4. The mid-trip stop according to claim 1, wherein the contact mechanism comprises a pair of contacts, one contact of which being suspended on a displaceable contact arm biased away from the other contact by a spring, the deactivated position representing a full displacement of the pair of contacts and the activated position representing at least partial closure of a gap between the contacts.

5. The mid-trip stop according to claim 1, wherein the contact mechanism comprises a pair of contacts, one contact of which being suspended on a displaceable contact arm biased away from the other contact by a spring, the deactivated position representing a full displacement of the pair of contacts and the activated position representing at least partial closure of a gap between the contacts, said rigid support further comprising a displacement surface adapted to be displaced by the contact arm in the deactivated position.

6. The mid-trip stop according to claim 1, wherein the contact mechanism is driven from the deactivated position to the activated position by a rotation of the external handle from the second position toward the first position.

7. The mid-trip stop according to claim 1, wherein the contact mechanism controls a degree of displacement of a set of contacts, the set of contacts having a contacting state and a non-contacting state, the activated position of the contact mechanism including both contacting and non-contacting states of the set of contacts.

8. The mid-trip stop according to claim 1, wherein the contact mechanism controls a degree of displacement of a set of contacts, the set of contacts having a contacting state and a non-contacting state, the trip mechanism causing the set of contacts to move from a contacting state to a non-contacting state before the contact mechanism achieves the deactivated position.

9. The mid-trip stop according to claim 1, wherein said displaceable mounting comprises a spring rotationally urging said support about an axis.

10. The mid-trip stop according to claim 1, wherein the member comprises a rod oriented parallel to the axis of rotation, said retaining means comprising a hook adapted to selectively capture the rod when the external handle is in the first position and the contact mechanism is in the activated position.

11. The mid-trip stop according to claim 1, wherein the member comprises a linkage between the external handle and the contact mechanism, the trip mechanism modulating a force applied by the external handle on the contact mechanism, the contact mechanism having a contact spring for achieving the deactivated position when the trip mechanism is in a tripped state.

12. The mid-trip stop according to claim 1, wherein said rigid support has three positions of displacement: a first position when the contact mechanism is in the deactivated position; a second position when the contact mechanism is in the activated position and the external handle is not in the first position; and a third position, intermediate between the first and second positions, when the contact mechanism is in the activated position and the external handle is in the first position.

13. The mid-trip stop according to claim 1, wherein the external handle, contact mechanism and trip mechanism are mounted to a common frame, the common frame being disposed at a predetermined position within an insulating housing, said displaceable mounting being independently attached to the insulating housing.

14. A mid-trip stop system, comprising:

A handle, displaceable about an axis of rotation between a first position and a second position, said handle being linked to a member whose position corresponds to a rotation position of said handle;

a contact mechanism, having an activated state and a relaxed state;

a spring urging said handle toward said second position;

a retainer, adapted for retaining said member when said handle is in the first position and the contact mechanism is in said activated state;

a stop surface, displaceably supported in relation to said axis of rotation, said stop surface being selectively disposed along a path of said member at a middle position of a transition path from said first position to said second position, and when so disposed being adapted to engage said member and counter a force of said spring, to retain said handle in said middle position of said transition path, such that a sufficient manual force applied to said handle when retained at said middle position of said transition path will compliantly displace said stop surface, allowing said handle to achieve said second position, while in an absence of the sufficient manual force and under influence of said spring alone, said stop surface remains in said transition path blocking said member, retaining said handle in the middle position.

15. The mid-trip stop system according to claim 14, wherein said stop surface is selectively disposed along said transition path dependent on a state of said contact mechanism.

16. The mid-trip stop system according to claim 14, wherein said stop surface is selectively disposed along said transition path when said contact mechanism is in said relaxed state.

17. The mid-trip stop system according to claim 14, wherein said stop surface and said retainer are linked by a rigid support.

18. The mid-trip stop system according to claim 14, wherein said stop surface and said retainer are linked by a rigid support, said rigid support being pivotally mounted with respect to said axis of rotation.

19. The mid-trip stop system according to claim 14, wherein the retainer is adapted to release said member when the contact mechanism is in said relaxed state.

20. The mid-trip stop system according to claim 14, further comprising a rigid support supporting said stop surface and said retainer, said rigid support being displaced by said contact mechanism in said relaxed state to a first displacement such that said stop surface is displaced to engage said member, said rigid support being displaced by action of a spring and said handle not being in said first position to a second displacement such that said stop surface is displaced to avoid engagement of said member, and said rigid support being displaced to a third displacement, intermediate between said first displacement and said second displacement and said retainer engaging said member, when said contact mechanism is in said activated state and said handle is in said first position.

21. The mid-trip stop system according to claim 14, wherein said stop surface is disposed outside of said transition path when said contact mechanism is in said activated state.

22. The mid-trip stop system according to claim 14, wherein said contact mechanism comprises a pair of contacts, one contact of which being suspended on a displaceable contact arm biased away from said other contact by a spring, said relaxed state representing a full displacement of said pair of contacts and said activated state representing at least partial closure of a gap between said contacts, said activated state comprising both contacting and non-contacting states of said pair of contacts, said relaxed state comprising only a non-contacting state of said pair of contacts.

23. The mid-trip stop system according to claim 14, wherein said member comprises a rod oriented parallel to said axis of rotation, said retainer comprising a hook adapted to selectively engage said rod when said handle is in said first position and said contact mechanism is in said activated state.

24. The mid-trip stop system according to claim 14, wherein said retainer further comprises a inclined surface for engaging said member during movement from said second to said first positions.

25. A method for externally indicating a state of a circuit breaker, comprising the steps of:

providing a contact mechanism, having a set of electrical contacts having a contacting position and a noncontacting position and means for automatically triggering a return from said contacting position to said noncontacting position;

providing a mechanical linkage between an external indicator, an internal member, and said contact mechanism, for manually actuating said contact mechanism between contacting and noncontacting positions by displacement of the external indicator, the external indicator and internal member sharing corresponding displacements and having means for generating a return force for urging the mechanical linkage from a second position to a first position, the first position corresponding to the contacting position and the second position corresponding to the noncontacting position;

providing a stop surface displaceably mounted on a rigid support, selectively disposable within a path of displacement of the internal member, the stop surface being disposed for impeding a displacement of the internal member when the contact mechanism is automatically triggered to return to a noncontacting position and not substantially impeding a displacement of the internal member when the contact mechanism is manually returned to a noncontacting position or when the contact mechanism is manually turned to a contacting position;

retaining the member against automatically triggered return from the first position when the contact mechanism is in the contacting position manually displacing the external indicator from the second position to the first position, thereby turning the contact mechanism from the noncontacting position to the contacting position;

automatically returning the contact mechanism to a noncontacting position, allowing the stop surface to impede the internal member and external indicator for retention in an intermediate position between the first position and the second position;

manually applying a force to the external indicator while retained in the intermediate position to provide a corresponding force to the internal member, to displace the stop surface from an impeding position; and manually applying a force to the external indicator to move from the first position to the second position.

* * * * *